US011506226B2

(12) United States Patent
Reeves et al.

(10) Patent No.: US 11,506,226 B2
(45) Date of Patent: Nov. 22, 2022

(54) HYBRID HYDRAULIC ACCUMULATOR

(71) Applicant: BASTION TECHNOLOGIES, INC, Houston, TX (US)

(72) Inventors: Joseph Reeves, League City, TX (US); Joseph Welker, League City, TX (US); Charles Don Coppedge, Brewer, ME (US)

( * ) Notice: Subject to any disclaimer, the term of this patent is extended or adjusted under 35 U.S.C. 154(b) by 0 days.

(21) Appl. No.: 16/775,751

(22) Filed: Jan. 29, 2020

(65) Prior Publication Data

US 2020/0240442 A1 Jul. 30, 2020

Related U.S. Application Data

(60) Provisional application No. 62/798,411, filed on Jan. 29, 2019.

(51) Int. Cl.
*F15B 1/08* (2006.01)
*F15B 15/19* (2006.01)

(52) U.S. Cl.
CPC ..... *F15B 1/08* (2013.01); *F15B 15/19* (2013.01)

(58) Field of Classification Search
CPC ..... F15B 15/19; F15B 1/08; F15B 2201/21
See application file for complete search history.

(56) References Cited

U.S. PATENT DOCUMENTS 2,979,094 A 4/1961 Royer
3,018,627 A 1/1962 Perricci
3,031,845 A 5/1962 Ludwig
3,077,077 A 2/1963 Jones
3,100,058 A 8/1963 Peet
3,100,965 A 8/1963 Blackburn
3,236,046 A 2/1966 Wellman
3,886,745 A 6/1975 Kaida et al.
3,933,338 A 1/1976 Herd et al.
4,074,527 A 2/1978 Sadler
4,163,477 A 8/1979 Johnson et al.
4,308,721 A 1/1982 Thomas et al.
4,412,419 A 11/1983 Thomas et al.
4,461,322 A 7/1984 Mills
4,619,111 A 10/1986 Whiteman
(Continued)

FOREIGN PATENT DOCUMENTS

CN 100419214 C 9/2008
CN 101377150 B 6/2012
(Continued)

OTHER PUBLICATIONS

International Search Report and Written Opinion for PCT/US2020/015424 dated Jul. 7, 2020. 11 pages.
(Continued)

*Primary Examiner* — David E Sosnowski
(74) *Attorney, Agent, or Firm* — Shackelford, Bowen, McKinley & Norton, LLP; Henry L. Ehrlich

(57) ABSTRACT

An exemplary hybrid accumulator includes a piston slidably disposed in a cylinder and separating a reservoir from a pressure chamber, in use, a hydraulic fluid disposed in the reservoir and a spring disposed in the pressure chamber to act on the piston and pre-charge the hydraulic fluid to a first pressure, and a heating element in communication with the pressure chamber to increase pressure in the pressure chamber when the heating element is initiated.

21 Claims, 3 Drawing Sheets

(56) References Cited

U.S. PATENT DOCUMENTS

| | | | | |
|---|---|---|---|---|
| 4,777,800 | A | 10/1988 | Hay, II | |
| 4,815,295 | A | 3/1989 | Narum | |
| 5,004,154 | A | 4/1991 | Yoshida et al. | |
| 5,072,896 | A | 12/1991 | McIntyre et al. | |
| 5,316,087 | A | 5/1994 | Manke et al. | |
| 5,481,977 | A | 1/1996 | Evans et al. | |
| 5,647,734 | A | 7/1997 | Milleron | |
| 6,202,753 | B1 | 3/2001 | Baugh | |
| 6,418,970 | B1 | 7/2002 | Deul | |
| 6,817,298 | B1 | 11/2004 | Zharkov et al. | |
| 7,011,722 | B2 | 3/2006 | Amtower, II | |
| 7,231,934 | B2 | 6/2007 | Biester | |
| 7,721,652 | B2 | 5/2010 | Yoshida et al. | |
| 7,810,569 | B2 | 10/2010 | Hill et al. | |
| 8,453,575 | B2 | 6/2013 | Humbert et al. | |
| 8,616,128 | B2 | 12/2013 | Sampson | |
| 9,212,103 | B2 * | 12/2015 | Coppedge | E21B 41/0007 |
| 9,435,356 | B1 | 9/2016 | Mallick et al. | |
| 9,689,406 | B2 | 6/2017 | Coppedge et al. | |
| 9,718,023 | B2 * | 8/2017 | Kanetsuki | B01D 53/228 |
| 9,856,889 | B2 | 1/2018 | Wilie | |
| 2005/0218359 | A1 | 10/2005 | Davis et al. | |
| 2009/0178433 | A1 | 7/2009 | Kumakura et al. | |
| 2009/0211239 | A1 | 8/2009 | Askeland | |
| 2010/0186960 | A1 | 7/2010 | Reitsma et al. | |
| 2010/0206389 | A1 | 8/2010 | Kennedy et al. | |
| 2011/0108285 | A1 | 5/2011 | Fagley, IV et al. | |
| 2011/0284237 | A1 | 11/2011 | Baugh | |
| 2012/0048566 | A1 | 3/2012 | Coppedge et al. | |
| 2012/0111572 | A1 | 5/2012 | Cargo, Jr. | |
| 2013/0220161 | A1 | 8/2013 | Coppedge et al. | |
| 2013/0220627 | A1 | 8/2013 | Coppedge et al. | |
| 2013/0220637 | A1 | 8/2013 | Fabela et al. | |
| 2016/0108934 | A1 | 4/2016 | Wilie | |
| 2016/0138524 | A1 | 5/2016 | Coppedge et al. | |
| 2016/0138617 | A1 | 5/2016 | Coppedge et al. | |
| 2016/0168936 | A1 | 6/2016 | Carisella et al. | |
| 2016/0369822 | A1 * | 12/2016 | Chen | F15B 11/08 |
| 2019/0048901 | A1 | 2/2019 | Bedrossian | |
| 2021/0285465 | A1 * | 9/2021 | Berkel | F15B 1/08 |

FOREIGN PATENT DOCUMENTS

| | | | |
|---|---|---|---|
| DE | 102007001645 | A1 | 7/2008 |
| EP | 0009346 | A1 | 4/1980 |
| GB | 2523079 | A | 8/2015 |

OTHER PUBLICATIONS

"Inert gas." Collins English Dictionary—Complete and Unabridged, 12th Edition 2014. 1991, 1994, 1998, 2000, 2003, 2006, 2007, 2009, 2011, 2014. HarperCollins Publishers May 5, 2021 https://www.thefreedictionary.com/inert+gas.

The Elements of Group 18 (The Noble Gases). Nov. 11, 2020, https://chem.libretexts.org/@go/page/6513.

Schrobilgen, Gary J.. "Noble gas". Encyclopedia Britannica, Oct. 23, 2020, https://www.britannica.com/science/noble-gas. Accessed May 5, 2021.

"Noble gas." Merriam-Webster.com Dictionary, Merriam-Webster, https://www.merriam-webster.com/dictionary/noble%20gas. Accessed May 5, 2021.

"Inert gas" https://en.wikipedia.org/w/index.php?title=Inert_gas&oldid=1020484498, accessed May 5, 2021.

* cited by examiner

HYBRID HYDRAULIC ACCUMULATOR

BACKGROUND

This section provides background information to facilitate a better understanding of the various aspects of the disclosure. It should be understood that the statements in this section of this document are to be read in this light, and not as admissions of prior art.

Pre-charged accumulators are widely used as the hydraulic power source for equipment, such as and without limitation, subsea blowout preventers (BOPs). Conventional pre-charged (pre-pressurized) accumulators typically use a gas, e.g. nitrogen, or mechanical spring to deliver the hydraulic power to actuate the hydraulically operated device. Conventional nitrogen accumulators have adequately served as a subsea hydraulic power source for many years. However, as wells are drilled in deeper water the efficiency of conventional accumulators significantly deceases.

As is well known in the art, the usable hydraulic fluid volume of a pre-charged accumulator is much less than the total volume of the stored hydraulic fluid. The usable volume or capacity of conventional pre-charged accumulators also decreases as the water depth increases. As depth increases, the operating temperature decreases and the subsea pressure that the rams are required to overcome increase. Since conventional accumulators are charged with gas on the surface, where temperatures may be 100 degrees Fahrenheit, the charge/spring gas cools when the accumulators are lowered to the seabed, where temperatures can be 32 degrees Fahrenheit or lower, reducing the gas pressure available for use by as much as 20% or more. Also, because BOPs must be closed quickly, conventional accumulators undergo a rapid adiabatic discharge that reduces the temperature and thus the pressure of the charge gas available to pressurize the hydraulic fluid. For example, in deep water, a 15-gal capacity conventional accumulator may only provide 0.5 gallons of usable hydraulic fluid. Thus, conventional accumulators require a capacity that is multiple times the usable fluid volume that can be delivered subsea. Thus, systems require more accumulators, which increase the weight and costs of the BOP stack.

Additionally, conventional pre-charged gas accumulators leak pressure requiring recharging due to gas leakage. Recharging a conventional accumulator that is located subsea may be impossible or prohibited from surface located pumps and/or require subsea recharging systems.

SUMMARY

An exemplary hybrid accumulator includes a piston slidably disposed in a cylinder and separating a reservoir from a pressure chamber, in use, a hydraulic fluid disposed in the reservoir and a spring disposed in the pressure chamber to act on the piston and pre-charge the hydraulic fluid to a first pressure, and a heating element in communication with the pressure chamber to increase pressure in the pressure chamber when the heating element is initiated.

An exemplary system includes a hydraulically operated customer having a hydraulic demand pressure for operation and a hybrid accumulator in communication with the customer to supply hydraulic fluid at or above the hydraulic demand pressure to operate the customer. The hybrid accumulator having a piston slidably disposed in a cylinder and separating a reservoir from a pressure chamber, a hydraulic fluid disposed in the reservoir, a port in communication between the reservoir and the customer, a spring disposed in the pressure chamber to act on the piston and pre-charge the hydraulic fluid to a first pressure, and a heating element in communication with the pressure chamber to increase pressure in the pressure chamber when the heating element is initiated.

An exemplary method for using a hydraulic accumulator associated with a wellbore includes: connecting a hybrid accumulator with a customer connected with the wellbore, the hybrid accumulator having a piston slidably disposed in a cylinder and separating a reservoir from a pressure chamber, a hydraulic fluid disposed in the reservoir, a port in communication between the reservoir and the customer, a spring disposed in the pressure chamber at a pre-charged spring pressure that is greater than a hydraulic demand pressure of the customer, and a heating element in communication with the pressure chamber; discharging a portion the hydraulic fluid through the port with the pre-charged spring pressure; initiating the heating element and increasing spring pressure in the pressure chamber in response to the pre-charged spring pressure decreasing to a pressure less than the hydraulic demand pressure; and discharging an additional portion of the hydraulic fluid through the port with the increased spring pressure.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
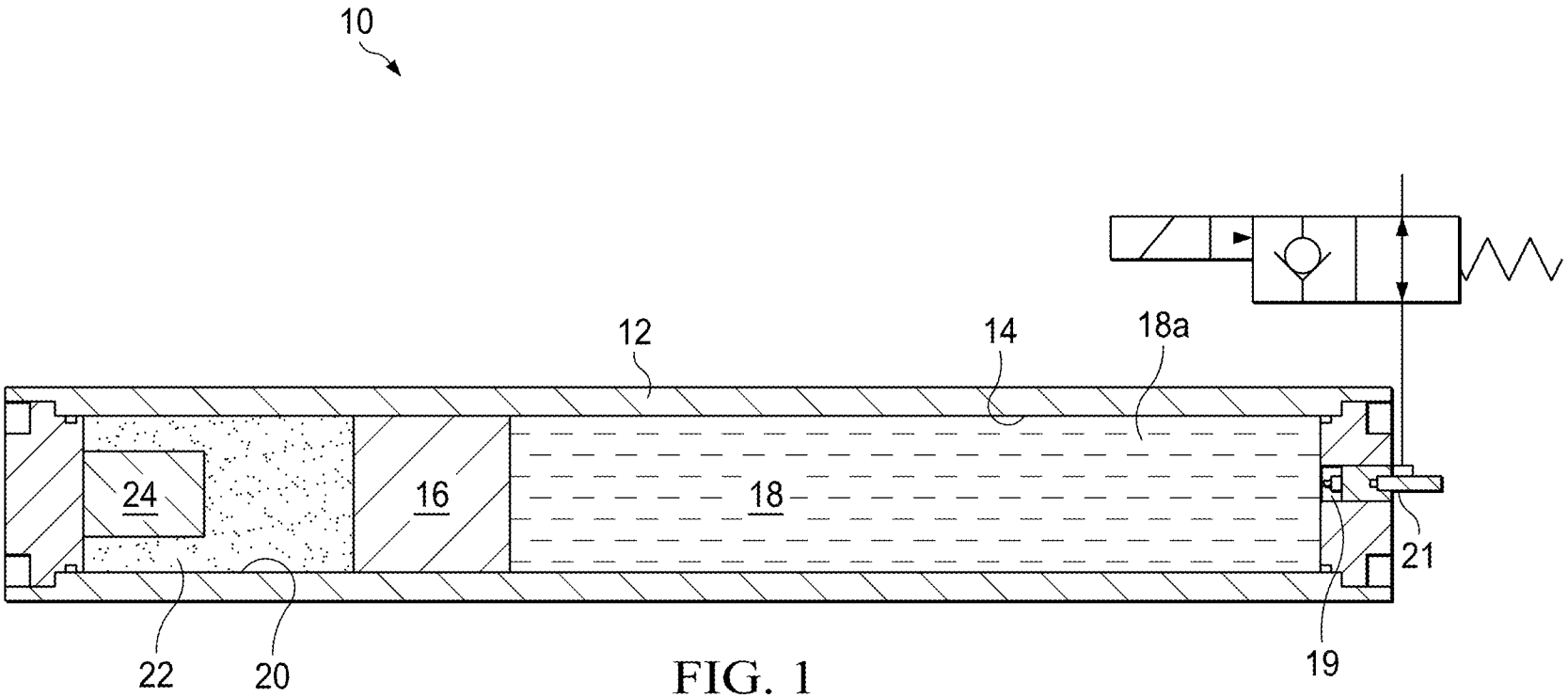
FIG. 1 illustrates an exemplary hybrid accumulator according to one or more aspects of the disclosure.

It is to be understood that the following disclosure provides many different embodiments, or examples, for implementing different features of various illustrative embodiments. Specific examples of components and arrangements are described below to simplify the disclosure. These are, of course, merely examples and are not intended to be limiting. For example, a figure may illustrate an exemplary embodiment with multiple features or combinations of features that are not required in one or more other embodiments and thus a figure may disclose one or more embodiments that have fewer features or a different combination of features than the illustrated embodiment. Embodiments may include some but not all the features illustrated in a figure and some embodiments may combine features illustrated in one figure with features illustrated in another figure. Therefore, combinations of features disclosed in the following detailed description may not be necessary to practice the teachings in the broadest sense and are instead merely to describe particularly representative examples. In addition, the disclosure may repeat reference numerals and/or letters in the various examples. This repetition is for the purpose of simplicity and clarity and does not itself dictate a relationship between the various embodiments and/or configurations discussed.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include such elements or features. As used herein, the terms "connect," "connection," "connected," "in connection with," and "connecting" may be used to mean in direct connection with or in connection with via one or more elements. Similarly, the terms "couple," "coupling," and "coupled" may be used to mean directly coupled or coupled via one or more elements.

Applicant has invented pyrotechnic and gas generator driven accumulators that are capable of delivering 100 percent of their hydraulic capacity regardless of water depth. Examples of Applicant's pyrotechnic driven accumulators are disclosed in U.S. Pat. No. 9,212,103, the teachings of which are incorporated herein by reference. Because of the 100% volumetric efficiency, the pyrotechnic driven accumulators weigh less, for example 70% less, and present a much smaller footprint than comparable conventional accumulators. Further, these pyrotechnic driven accumulators do not require a control system and are therefore particular suited to use in deadman autoshear systems.

The exemplary hybrid accumulators disclosed herein combine a spring to provide conventional hydraulic flow and a heating element to provide an increased pressure hydraulic flow. The hybrid accumulator flows conventionally until the pre-charged pressure is generally equal to the hydraulic demand pressure of the customer and then the heating element is applied to boost pressure and generate hydraulic flow at greater volume, speed and pressure. In the conventional hydraulic flow regime, the hybrid accumulator can be used many times to operate one or more customers. For example, the hybrid accumulator may be used in the conventional flow regime to operate valves and perform single ram closures and function tests of the hybrid accumulator and function tests of the customer. When the pre-charged pressure declines to about the hydraulic demand pressure of the customer, the heating element (e.g., gas generator, pyrotechnic charge) is initiated to increase pressure above the hydraulic demand pressure and discharge the total hydraulic fluid volume from the hybrid accumulator. In conventional hydraulic accumulators, only a portion of the total volume is useable for tool actuation. Hybrid accumulators can significantly reduce the hydraulic volume, weight, and foot print of the hydraulic accumulator systems over conventional hydraulic accumulators. Pre-charged pressure, or pre-charged spring pressure, is used herein to describe the pressure, a gas pressure and/or a mechanical spring force, that is supplied in the pressure chamber and applied from the pressure chamber via the piston to the hydraulic fluid prior to initiating the heating element to increase the pressure, also referred to as spring pressure, in the pressure chamber.

FIG. 1 schematically illustrates an exemplary hybrid accumulator generally denoted by the numeral 10. Hybrid accumulator 10 includes a cylinder 12 having a bore 14. A piston 16 is disposed in the bore separating hydraulic fluid 18 in a reservoir 18*a* from a pressure chamber 20. Reservoir 18*a* includes a port 19 for operational connection with a hydraulically operated customer, e.g., valve, ram, blowout preventer, tubular shear. Flow of hydraulic fluid 18 from reservoir 18*a* can be regulated by a control valve 21. In use, pressure chamber 20 includes a spring 22, illustrated as an inert gas, e.g., nitrogen, that is charged to a first pre-charged spring pressure that is greater than the hydraulic demand pressure of the associated hydraulic customer. Spring 22 may be a mechanical spring or a combination of a mechanical spring and a gas. The pre-charged spring pressure in pressure chamber 20 is greater than the hydraulic demand pressure permitting hybrid accumulator 10 to operate the customer and/or perform function tests under the conventional flow regime. A heating element 24 is in communication with pressure chamber 20 to increase the spring pressure when heating element 24 is initiated. Heating element 24 can increase the spring pressure by superheating inert gas and or by generating high pressure gas in pressure chamber 20. In the exemplary embodiment, heating element 24 is a gas generator (e.g., liquid propellant, mono-propellant) or pyrotechnic charge (e.g., solid propellant). Heating element 24 is not limited to a gas generator or pyrotechnic charge and may include other devices and materials including an electric heating element.

Initiating heating element 24 increases the spring pressure in pressure chamber 20 and the increased spring pressure acts on piston 16 and increases the pressure of hydraulic fluid 18. In an exemplary embodiment, heating element 24 increases the spring pressure whereby the full volume, or substantially the full volume, of hydraulic fluid 18 can be discharged at or above the hydraulic demand pressure. It will be understood by those skilled in the art with benefit of this disclosure that a hydraulic customer (device or system) may have different hydraulic demand pressures. For example, a valve or ram may require a different pressure to operate in different wellbore conditions. Accordingly, the pre-charged spring pressure may provide a sufficient pressure to perform various operations and tests before the spring pressure and hydraulic pressure decline to the hydraulic demand pressure and then the heating element can be initiated to increase the spring pressure to surpass the hydraulic demand pressure. In accordance to some embodiments, the heating element can increase the spring pressure and discharge the full volume of the hydraulic fluid at or above a maximum anticipated wellhead pressure (MAWHP).

In an exemplary embodiment, hybrid accumulator 10 is about 11-feet long, 13.5 inches in diameter, and weighs approximately 1500 pounds and hydraulic reservoir 18*a* has an initial total volume of 25 gallons including about 11 gallons available for use in the conventional flow regime under the pre-charged spring pressure. Unlike a conventional accumulator, the full volume of hydraulic fluid can be delivered to the customer at the hydraulic demand pressure, e.g. the MAWHP plus water depth. The increased pressure regime, achieved by initiating the heating element, may produce a spring pressure significantly greater than the pre-charged spring pressure through the full stroke of the piston.

Figure 2:
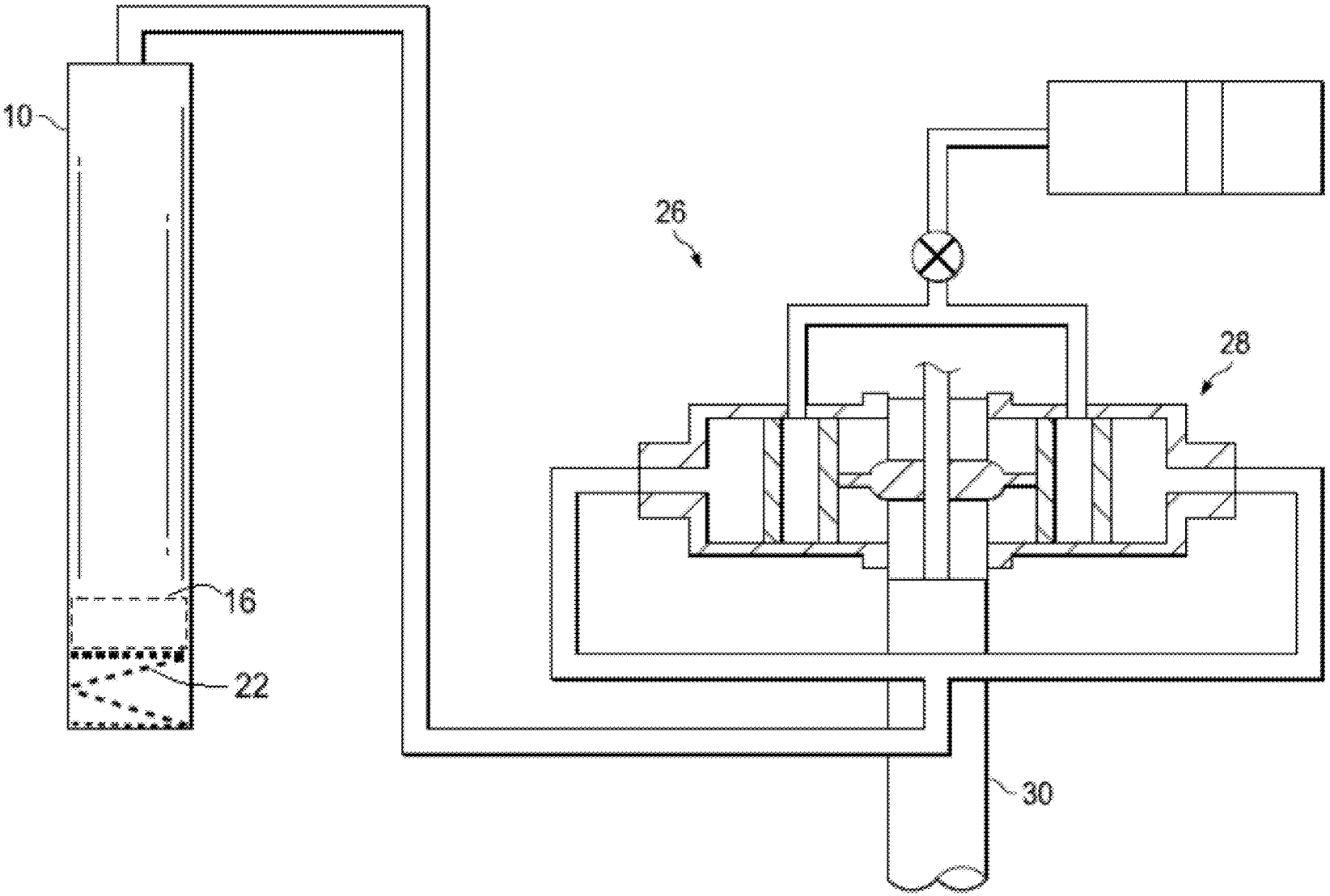
FIG. 2 illustrates a hydraulic system incorporating a hybrid accumulator according to one or more aspects of the disclosure.

FIG. 2 schematically illustrates an exemplary hybrid accumulator 10 connected with an exemplary hydraulic customer 26. In this example, hydraulic customer 26 is a tool in a blowout preventer assembly 28 that is connected in a wellbore 30. It will be recognized by those skilled in the art with benefit of this disclosure that in operation multiple hybrid hydraulic accumulators 10 may be assembled in a pod and hydraulically connected to hydraulic customer 26, which may be a system having one or more hydraulically operated devices. With regard to a blowout preventer assembly, hydraulic customer 26 may include, for example, one or more valves and one or more rams. Wellbore 30 may be a land or subsea wellbore. Wellbore 30 may be in the process of being drilled, an exploration well, or a production well. For purposes of clarity, hydraulic customer 26 is not limited to tools assembled in or associated with a BOP. Hydraulic customer 26 may be a tool disposed subsurface in the wellbore or a tool associated with the wellbore. As will be understood by those skilled in the art with benefit of this disclosure, hydraulic customer 26 and hybrid accumulator 10 are not limited to wellbore applications.

Figure 3:
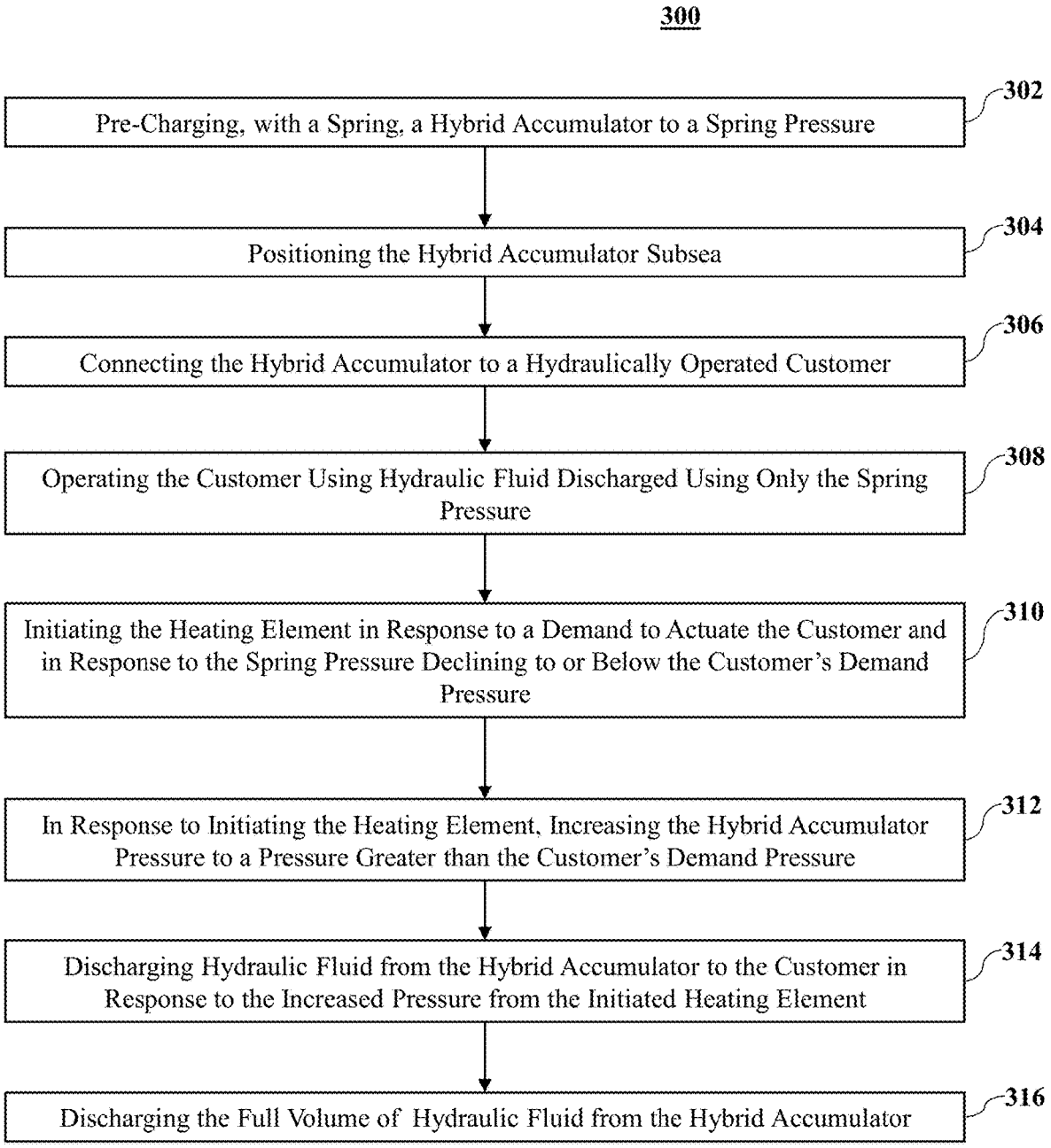
FIG. 3 is a block diagram of an exemplary method according to one or more aspects of the disclosure.

FIG. 3 illustrates an exemplary method 300 that is described with reference to FIGS. 1-3. At block 302, hybrid accumulator 10 is pre-charged to a first spring pressure by spring 22, which in this example is an inert gas. Hydraulic reservoir 18*a* contains a total volume of hydraulic fluid 18. At block 304, hybrid accumulator 10 is positioned subsea. At block 306, hybrid accumulator 10 is connected via port 19, and control valve 21, to a hydraulically operated customer 26, which may be a hydraulic circuit with one or more hydraulically operated devices. At block 308, hybrid accumulator 10 is operated under conventional flow using the pre-charged spring pressure to apply a first volume of hydraulic fluid 18, less than the total volume, to hydraulic customer 26. This conventional flow operation may be performed to actuate hydraulic customer 26, function test hybrid accumulator 10 or function test hydraulic customer 26. The total hydraulic fluid volume of hybrid accumulator 10 includes a conventional volume that can be used under conventional flow before the first spring pressure decreases to a pressure less than the hydraulic demand pressure. At block 310, heating element 24 is initiated in response to a demand to supply hydraulic flow to customer 26 and in response to the pre-charged pressure in pressure chamber 20 declining to or below the hydraulic demand pressure of customer 26. In an exemplary embodiment, heating element 24 is not initiated when the pre-charged spring pressure in chamber 20 decreases below the hydraulic demand pressure unless there is also a demand to operate customer 26. At block 312, initiated element 24 increases the spring pressure to a pressure greater than the hydraulic demand pressure of customer 26 to discharge hydraulic fluid 18. At block 314, hydraulic fluid 18 is discharged by the increased spring pressure in response to the demand to operate customer 26. At block 316, the full volume of hydraulic fluid 18 is discharged from hybrid accumulator 10 and supplied to customer 26 at a pressure equal to or greater than the hydraulic demand pressure of customer 26.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure and that they may make various changes, substitutions, and alterations without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A system comprising:

a hydraulically operated customer having a hydraulic demand pressure for operation; and a hybrid accumulator in communication with the customer to supply hydraulic fluid at or above the hydraulic demand pressure to operate the customer, the hybrid accumulator comprising:

a piston slidably disposed in a cylinder and separating a reservoir from a pressure chamber;

a hydraulic fluid disposed in the reservoir;

a port in communication between the reservoir and the customer;

a spring comprising an inert gas disposed in the pressure chamber to act on the piston, without being heated, and pre-charge the hydraulic fluid to a first pressure that is greater than the hydraulic demand pressure; and a heating element in communication with the pressure chamber to increase pressure in the pressure chamber when the heating element is initiated, wherein the heating element is a pyrotechnic device.

2. The system of claim 1, wherein the customer is a tool connected to a wellbore.

3. The system of claim 2, wherein the hydraulic demand pressure is a maximum anticipated wellhead pressure.

4. A method for using a hydraulic accumulator associated with a wellbore, the method comprising:

using the hydraulic accumulator with a customer connected with the wellbore, the hydraulic accumulator comprising a piston slidably disposed in a cylinder and separating a reservoir from a pressure chamber, a hydraulic fluid disposed in the reservoir, a port in communication between the reservoir and the customer, a spring disposed in the pressure chamber and applying a pre-charged spring pressure that is greater than a hydraulic demand pressure of the customer, and a heating element in communication with the pressure chamber, wherein the heating element is a pyrotechnic device and the pre-charged spring pressure is applied without heating the spring; and function testing the hydraulic accumulator and/or the customer by discharging a first portion of the hydraulic fluid through the port with only the pre-charged spring pressure.

5. The method of claim 4, further comprising:

initiating the heating element, after the function testing, in response to a demand to operate the customer and to the pre-charged spring pressure decreasing to a pressure less than the hydraulic demand pressure; and discharging an additional portion of the hydraulic fluid through the port in response to the initiating the heating element.

6. The method of claim 5, wherein a total volume of the hydraulic fluid is discharged from the reservoir.

7. The method of claim 4, wherein the spring comprises a mechanical spring.

8. The method of claim 4, wherein the hydraulic accumulator and the wellbore are located subsea; and the hydraulic demand pressure is a maximum anticipated wellhead pressure.

9. The method of claim 8, wherein the spring comprises a mechanical spring.

10. The method of claim 8, further comprising:

initiating the heating element, after the function testing, in response to a demand to operate the customer and to the pre-charged spring pressure decreasing to a pressure less than the hydraulic demand pressure; and discharging an additional portion of the hydraulic fluid through the port in response to the initiating the heating element.

11. The method of claim 10, wherein the spring comprises a mechanical spring.

12. A method for using a hydraulic accumulator associated with a wellbore, the method comprising:

using the hydraulic accumulator with a customer connected with the wellbore, wherein the hydraulic accumulator and the wellbore are located subsea, the hydraulic accumulator comprising a piston slidably disposed in a cylinder and separating a reservoir from a pressure chamber, a hydraulic fluid disposed in the reservoir, a port in communication between the reservoir and the customer, a spring disposed in the pressure chamber and applying a pre-charged spring pressure that is greater than a hydraulic demand pressure of the customer, and a heating element in communication with the pressure chamber, wherein the heating element is a gas generator and the pre-charged spring pressure is applied without heating the spring; and function testing the hydraulic accumulator and/or the customer by discharging a first portion of the hydraulic fluid through the port with only the pre-charged spring pressure.

13. The method of claim 12, further comprising:

initiating the heating element, after the function testing, in response to a demand to operate the customer and to the pre-charged spring pressure decreasing to a pressure less than the hydraulic demand pressure; and discharging an additional portion of the hydraulic fluid through the port in response to the initiating the heating element.

14. The method of claim 12, wherein the hydraulic demand pressure is a maximum anticipated wellhead pressure.

15. The method of claim 14, further comprising:

initiating the heating element, after the function testing, in response to a demand to operate the customer and to the pre-charged spring pressure decreasing to a pressure less than the hydraulic demand pressure; and discharging an additional portion of the hydraulic fluid through the port in response to the initiating the heating element.

16. A system comprising:

a hydraulically operated customer having a hydraulic demand pressure for operation, wherein the customer is a tool connected to a subsea wellbore; and a hybrid accumulator in communication with the customer to supply hydraulic fluid at or above the hydraulic demand pressure to operate the customer, the hybrid accumulator comprising:

a piston slidably disposed in a cylinder and separating a reservoir from a pressure chamber;

a hydraulic fluid disposed in the reservoir;

a port in communication between the reservoir and the customer;

a spring comprising an inert gas disposed in the pressure chamber to act on the piston, without being heated, and pre-charge the hydraulic fluid to a first pressure that is greater than the hydraulic demand pressure; and a heating element in communication with the pressure chamber to increase pressure in the pressure chamber when the heating element is initiated, wherein the heating element is a gas generator or a pyrotechnic device.

17. The system of claim 16, wherein the hydraulic demand pressure is a maximum anticipated wellhead pressure.

18. The system of claim 16, wherein the heating element is a gas generator.

19. The system of claim 16, wherein the heating element is a pyrotechnic device.

20. The system of claim 16, wherein the hydraulic demand pressure is a maximum anticipated wellhead pressure; and the heating element is a gas generator.

21. The system of claim 16, wherein the hydraulic demand pressure is a maximum anticipated wellhead pressure; and the heating element is a pyrotechnic device.

* * * * *